US012006719B2

(12) United States Patent
Lu et al.

(10) Patent No.: US 12,006,719 B2
(45) Date of Patent: Jun. 11, 2024

(54) FOLDING TENT CAPABLE OF BEING UNFOLDED AND FOLDED RAPIDLY

(71) Applicant: Nengxiao Lu, Zhejiang (CN)

(72) Inventors: Nengxiao Lu, Zhejiang (CN); Xingchen Lu, Zhejiang (CN)

(73) Assignee: Nengxiao Lu, Zhejiang (CN)

( * ) Notice: Subject to any disclaimer, the term of this patent is extended or adjusted under 35 U.S.C. 154(b) by 150 days.

(21) Appl. No.: 17/641,094

(22) PCT Filed: Jan. 27, 2022

(86) PCT No.: PCT/CN2022/074168

§ 371 (c)(1),
(2) Date: Mar. 8, 2022

(87) PCT Pub. No.: WO2023/070979

PCT Pub. Date: May 4, 2023

(65) Prior Publication Data

US 2023/0287703 A1 Sep. 14, 2023

(30) Foreign Application Priority Data

Oct. 26, 2021 (CN) ..... 202122582025.5

(51) Int. Cl.
*E04H 15/48* (2006.01)
*E04H 15/32* (2006.01)
*E04H 15/50* (2006.01)

(52) U.S. Cl.
CPC ..... *E04H 15/48* (2013.01); *E04H 15/32* (2013.01); *E04H 15/50* (2013.01)

(58) Field of Classification Search
CPC ..... E04H 15/28; E04H 15/322
See application file for complete search history.

(56) References Cited

U.S. PATENT DOCUMENTS 1,219,847 A * 3/1917 Nettenstrom ..... E04H 15/28 135/147
1,449,894 A * 3/1923 Dial ..... E04H 15/28 135/153

(Continued)

FOREIGN PATENT DOCUMENTS

CN 1483912 3/2004
CN 201539127 8/2010

(Continued)

OTHER PUBLICATIONS

"International Search Report (Form PCT/ISA/210) of PCT/CN2022/074168," mailed on Jul. 21, 2022, pp. 1-4.

*Primary Examiner* — David R Dunn
*Assistant Examiner* — Danielle Jackson
(74) *Attorney, Agent, or Firm* — JCIPRNET

(57) ABSTRACT

Disclosed is a folding tent capable of being unfolded and folded rapidly, comprising leg tubes and an tent ejector rod part, wherein one end of the tent ejector rod part is hinged to an upper connecting disk, the other end of the tent ejector rod part is hinged to an upper portion of the leg tube; the tent ejector rod part comprises at least two ejector rod units hinged to each other, each ejector rod unit hinged to the upper connecting disk is provided with a supporting rod in a fitting manner, and the other end of the supporting rod is hinged to a lower connecting disk; a connecting rod is further arranged between at least one supporting rod and the ejector rod unit installed on the supporting rod in a fitting manner, and one end of the connecting rod is used to be in hinge fit with the ejector rod unit. A hinge joint is located at a position between a hinge joint of the supporting rod and the ejector rod unit and the upper connecting disk, and the other end of the connecting rod is in hinge fit with a sliding part; the sliding part slides along the supporting rod, and the (Continued)

sliding part is locked by a locking mechanism when the folding tent is fully unfolded.

16 Claims, 9 Drawing Sheets

(56) References Cited

U.S. PATENT DOCUMENTS

| | | | | | |
|---|---|---|---|---|---|
| 2,530,765 | A * | 11/1950 | Greenup | ..... | E04H 15/28 135/147 |
| 4,478,234 | A * | 10/1984 | Bester | ..... | E04H 15/48 135/93 |
| 2006/0289048 | A1 | 12/2006 | Choi | | |

FOREIGN PATENT DOCUMENTS

| | | |
|---|---|---|
| CN | 202850585 | 4/2013 |
| CN | 205531639 | 8/2016 |
| CN | 208168524 | 11/2018 |
| CN | 111287548 | 6/2020 |
| CN | 212317626 | 1/2021 |
| CN | 213269205 | 5/2021 |
| DE | 202019102725 U1 * | 7/2019 |

* cited by examiner

FOLDING TENT CAPABLE OF BEING UNFOLDED AND FOLDED RAPIDLY

CROSS-REFERENCE TO RELATED APPLICATION

This application is a 371 of international application of PCT application serial no. PCT/CN2022/074168, filed on Jan. 27, 2022, which claims the priority benefit of China application no. 202122582025.5, filed on Oct. 26, 2021. The entirety of each of the above mentioned patent applications is hereby incorporated by reference herein and made a part of this specification.

FIELD OF TECHNOLOGY

The present invention relates to the technical field of folding tents, and in particular relates to a folding tent capable of being unfolded and folded rapidly.

BACKGROUND

Due to effects of convenient carrying and sun and rain shading, the folding tent is extensively used; the tent needs to be unfolded during use and needs to be folded for storage when not in use, thus a mechanism for achieving unfolding and folding of the folding tent is particularly important.

An existing mechanism for unfolding and folding the folding tent is complex in structure, and generally needs simultaneous operation of multiple persons to complete the storage of the folding tent. For example, disclosed is a quick folding tent and a sliding block locking mechanism in publication number 201220456317.2. The quick folding tent comprises a plurality of telescopic legs, eave crossover tubes, sliding blocks and a sliding block locking mechanism, the eave crossover tubes are connected to the sliding blocks, and the sliding blocks can vertically slide along the telescopic legs, wherein the sliding block locking mechanism comprises a spring and a spherical part, the spring and the spherical part are located in one of the telescopic leg and the sliding block, and the other one of the telescopic leg and the sliding block is provided with a pit or a hole separably fitted with the spherical part; the spherical part can be in fit with the pit or the hole to lock the sliding block under the action of the spring or can be in separable fit with the pit or the hole to make the slide block slide along the telescopic leg. In accordance with above structure, the unfolding and folding or storage of the folding tent can be achieved only by achieving unlocking of four supporting legs, the folding tent is relatively tedious and complex in structure and operation, and is inconvenient to operate and use by a single person.

To this end, disclosed is a tent in publication number CN111287548A. The tent comprises supporting legs and an inner telescopic unit, wherein the inner telescopic unit comprises a first inclined jacking tube; the first inclined jacking tube is hinged to a first connecting rod, and the tent further comprises a central lock, the central lock comprises a central rod, a central top cap fixedly arranged at one end of the central rod, and a central bottom cap separately connected to the other end of the central rod, and the supporting legs are connected to the central lock through the inner telescopic unit; the first inclined jacking tube is hinged to the central top cap of the central lock; the first connecting rod is hinged to the central bottom cap of the central lock; and a locking part is accommodated in the center bottom cap, a first through hole allowing the central rod to penetrate through is formed in the locking part, and a clamping and locking portion is arranged at the end part of the central rod. When the central lock is in a locked state, the upper end face of the clamping and locking portion abuts against the lower end face of the locking part, when the central lock is in an unlocked state, the clamping and locking portion can pass through the first through hole. The tent with the central lock capable of supporting the whole tent and enabling the tent to be stressed uniformly is provided.

According to above technical solution, the operation step is simplified, and the operation of unfolding and folding the tent by a single person can be achieved. However, as the central top cap, the central bottom cap, the first inclined jacking tube and the first connecting rod are all arranged in a hinged structure, and particularly, the folding tent needs to be unfolded and folded through locking fit or separable fit of the central rod and the central bottom cap, in the actual use process, due to the influence of clearances among all components, the locking alignment between the central rod and the central bottom cap is prone to deviation, resulting in frequent needing of manual adjustment of the position of the central rod to complete the locking. In addition, in the actual operation process, when the central bottom cap is supported and the central rod abuts against the central bottom cap, in a case that a user does not pay attention, it is easy to pinch the fingers into the installation portion to cause bump injuries, thus affecting the use of the effect.

SUMMARY

An objective of the present invention is to provide a folding tent capable of being unfolded and folded rapidly to solve above technical problems, a triangular positioning is formed among a supporting rod, a connecting rod and an ejector rod unit to make the whole tent have good stability, thus achieving the advantages of being smooth in locking and reliable in locking.

The technical problem solved by the present invention may be achieved using the following technical solutions:

a folding tent capable of being unfolded and folded rapidly, comprising leg tubes and an tent ejector rod part, wherein one end of the tent ejector rod part is hinged to an upper connecting disk, the other end of the tent ejector rod part is hinged to an upper portion of the leg tube; the tent ejector rod part comprises at least two ejector rod units hinged to each other, each ejector rod unit hinged to the upper connecting disk is provided with a supporting rod in a fitting manner, and the other end of the supporting rod is hinged to a lower connecting disk; a connecting rod is further arranged between at least one supporting rod and the ejector rod unit installed on the supporting rod in a fitting manner, and one end of the connecting rod is used to be in hinge fit with the ejector rod unit. A hinge joint is located at a position between a hinge joint of the supporting rod and the ejector rod unit and the upper connecting disk, and the other end of the connecting rod is in hinge fit with a sliding part; the sliding part slides along the supporting rod and is locked by a locking mechanism when the folding tent is fully unfolded.

When the folding tent progresses from a folded state to an unfolded state, the sliding part slides towards a direction of the lower connecting disk along the supporting rod, and the sliding part is locked by the locking mechanism until the folding tent is fully unfolded; when the sliding part is unlocked from the locking mechanism, the sliding part can slide in a direction away from the lower connecting disk along the supporting rod, and the folding tent progresses from the unfolded state to the folded state.

The sliding part comprises a sliding sleeve body, the sliding sleeve body is used to achieve sliding fit with the supporting rod, the connecting rod is in hinge fit with the sliding sleeve body, the sliding sleeve body is provided with a locking notch, and the locking notch is used to be in locking fit with the locking mechanism.

The locking mechanism is used to be in installation fit with the lower connecting disk, the locking mechanism comprises a lock hook component, a lock pin component and a reset spring; the lock pin component is used to drive the lock hook component to achieve position change, the reset spring is used to reset the lock hook component, and the lock hook component is used to be in locking fit with the lock notch.

The lock hook component comprises a lock hook body and a lock hook cantilever, one side face of the lock hook body is provided with an inclined plane, the lower surface of the lock hook cantilever is provided with a boss, the boss is used to be in fit with one end of the reset spring, the other end of the reset spring abuts against an inner cavity wall of the lower connecting disk, and the other end of the lock hook cantilever is fixedly installed to the lock pin component.

The lock pin component comprises a lock pin body, the lock pin body is accommodated in an inner cavity of the lower connecting disk, and the lock pin body can move up and down along the inner cavity of the lower connecting disk.

An accommodating groove is formed in a hinge portion of the lower connecting disk and the supporting rod, and the accommodating groove is used to be in fit with the sliding sleeve body, the lock hook body can extend into the accommodating groove to be locked with the locking notch on the sliding sleeve body in a fitting manner.

When the lock pin body moves downwards, the lock pin component drives the lock hook component to move, thus making the lock hook body be disengaged from the locking notch to complete the unlocking of the sliding part.

A lower portion of the lock pin body extends to the outside of the lower connecting disk and is installed at a lock pin pull ring in a fitting manner, and the lock pin pull ring is used to pull the lock pin body to move up and down along the inner cavity of the lower connecting disk.

The lower connecting disk is provided with four supporting rods in a hinge fitting manner, any one supporting rod or any two supporting rods or four supporting rods are provided with the sliding part in a fitting manner, and the single sliding part is used to be installed on the single supporting rod in a fitting manner.

The locking mechanism comprises an elastic bean part, the elastic bean part comprises a retractable elastic bean body, and the elastic bean body is used to be in locking fit with the locking notch.

The elastic bean part is used to be in installation fit with the supporting rod, and the elastic bean part is installed in the inner cavity at the position, close to the lower connecting disk, of the supporting rod, a first elastic bean hole is formed in the supporting rod, and the elastic bean body can protrude from the first elastic bean hole.

An installation cavity groove is formed in the lower connecting disk, and the installation cavity groove is used to install the elastic bean in a fitting manner; a second elastic bean hole is formed in the installation cavity groove, and the accommodating groove is formed in the hinge portion of the lower connecting disk and the supporting rod, the accommodating groove is used to be in fit with the sliding sleeve body, and the elastic bean body can protrude from the second elastic bean hole to extend into the accommodating cavity, thus achieving the locking with the locking notch.

The lower connecting disk is further provided with an operating part which is used for release the locking of the elastic bean body and the locking notch.

A clamping seat is arranged between any two mutually hinged ejector rod units in a fitting manner, the clamping seat comprises an installation portion and a clamping portion, the installation portion is used to be installed on any one of the two mutually hinged ejector rod units, and when the folding tent is unfolded, the clamping portion is used to clamp and fix the other ejector rod unit.

An installation sleeve cavity is arranged in the installation portion, the installation sleeve cavity and the ejector rod unit are installed in a nesting manner, and the installation portion is installed at adjacent ends or close to end parts of the ejector rod units.

Compared with the prior art, the present invention has the following prominent advantages and effects: a lateral locking structure is adopted through optimal design, and a triangular positioning is formed among the supporting rod, the connecting rod and the ejector rod unit to make the whole tent have good stability, thus achieving the advantages of being smooth in locking and reliable in locking; the fitting of the sliding part and the locking mechanism is optimized to achieve quick and convenient unfolding and folding, thus completing the unfolding or folding of the folding tent.

The features of the present invention can be clearly understood with reference to the drawings of the present case and the detailed description of the following preferred embodiments.

DESCRIPTION OF THE EMBODIMENTS

Figure 1:
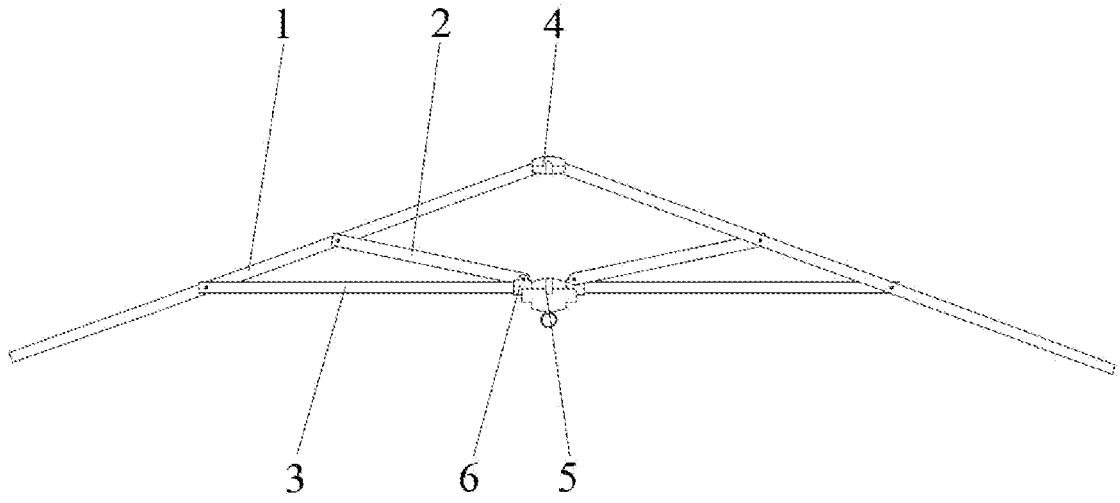
FIG. 1 is an unfolded structure diagram of a folding tent of the present invention.
Figure 2:
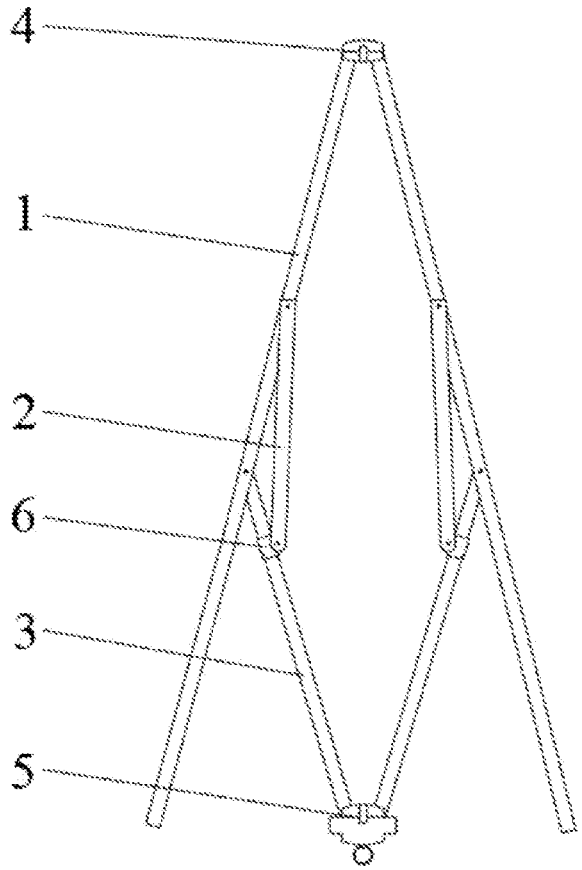
FIG. 2 is a folded structure diagram of a folding tent of the present invention.
Figure 3:
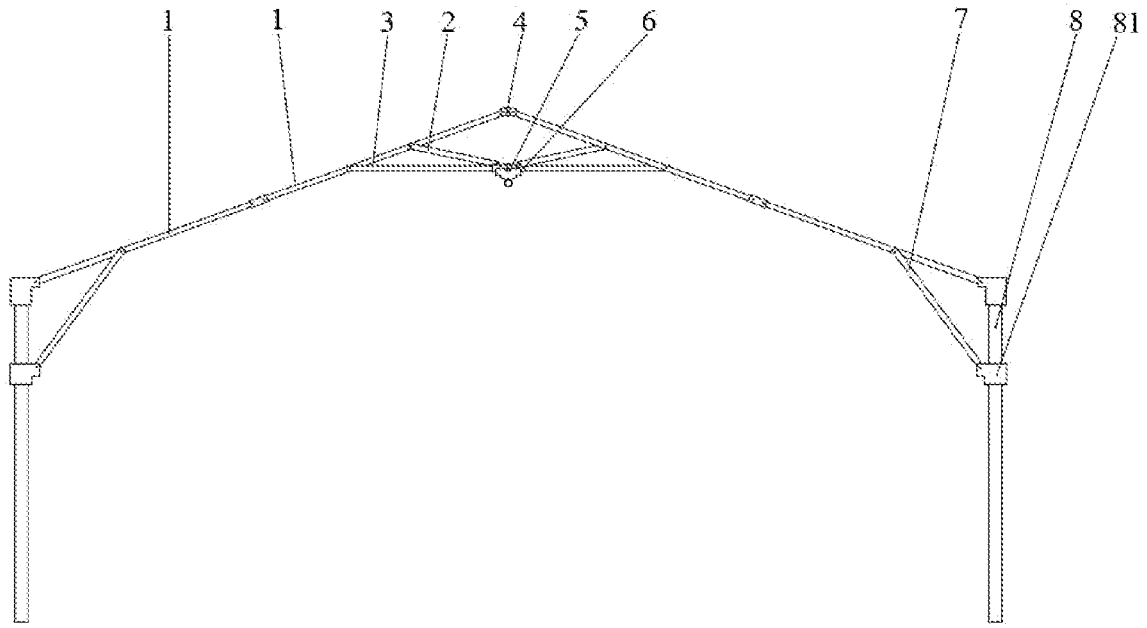
FIG. 3 is an overall unfolded structure diagram of a folding tent of the present invention.
Figure 4:
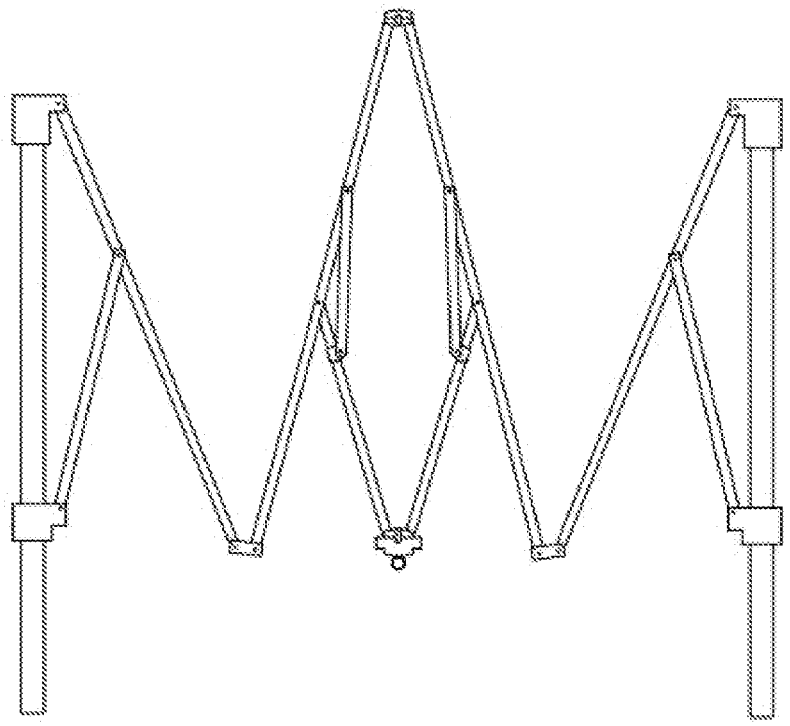
FIG. 4 is an overall folded structure diagram of a folding tent of the present invention.
Figure 5:
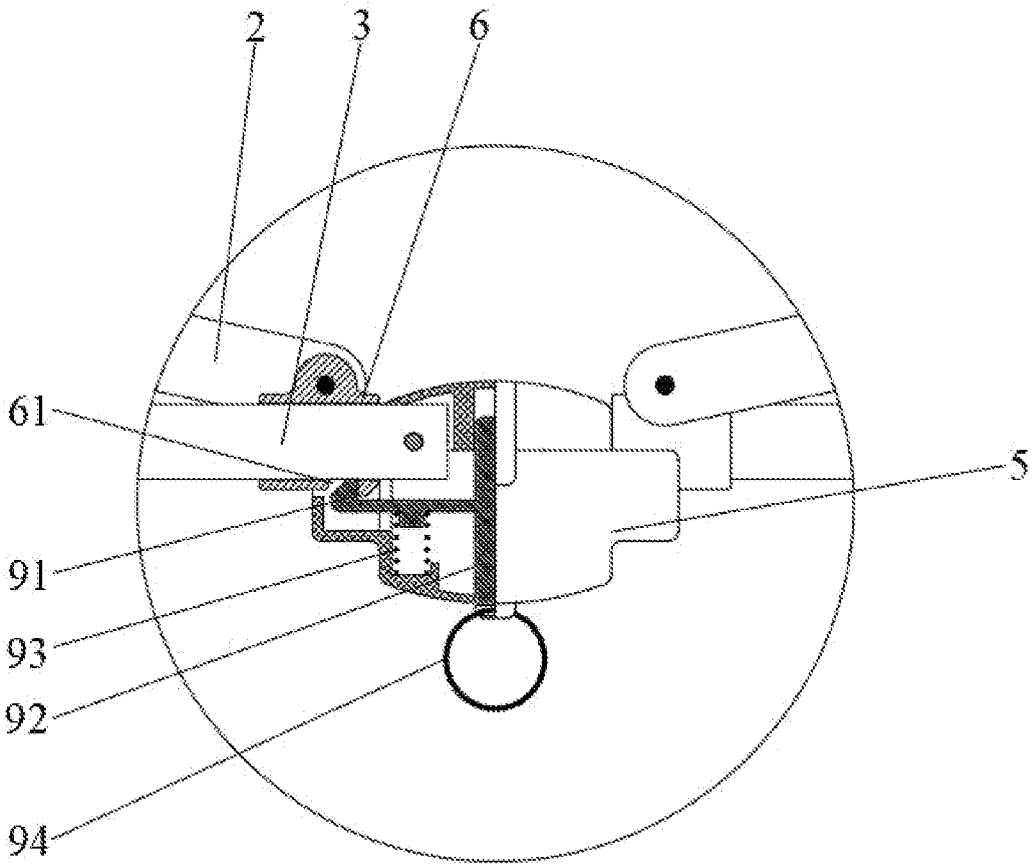
FIG. 5 is a locking structure diagram of a locking mechanism of the present invention.
Figure 6:
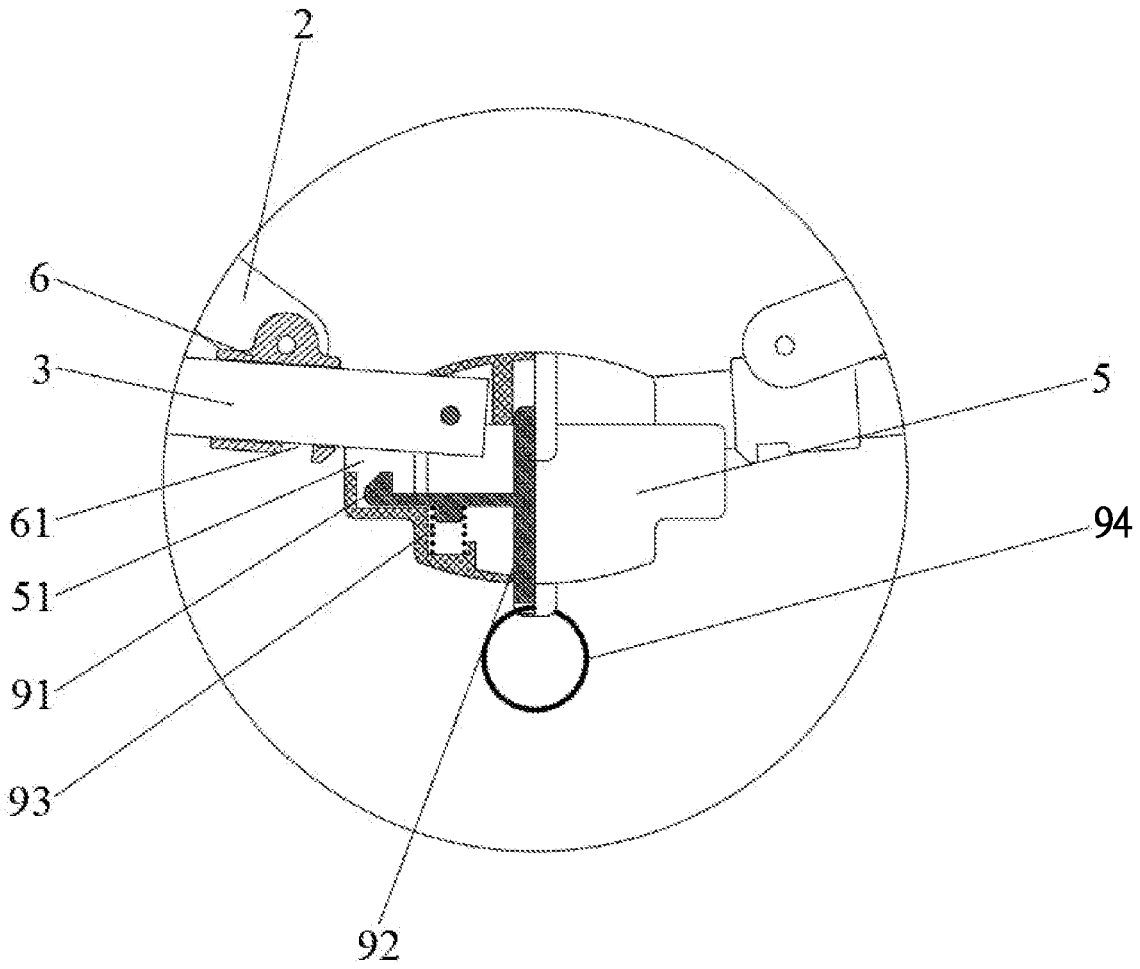
FIG. 6 is an unlocking structure diagram of a locking mechanism of the present invention.
Figure 7:
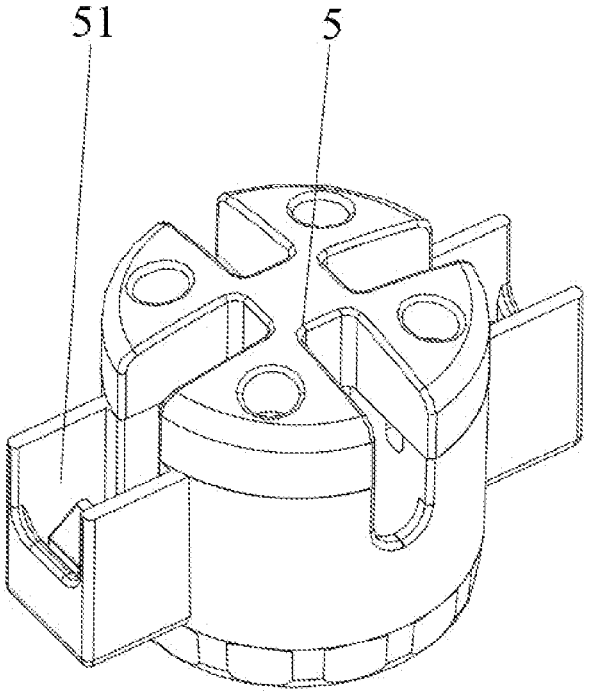
FIG. 7 is a structure diagram of a lower connecting disk of the present invention.
Figure 8:
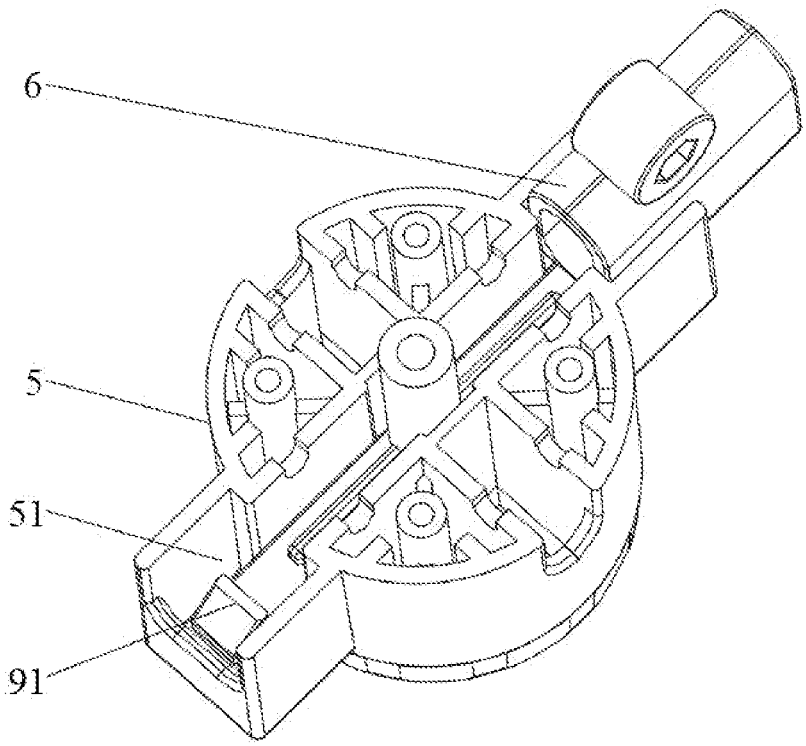
FIG. 8 is an installation structure diagram of a lower connecting disk, a sliding part and a lock hook component of the present invention.

To make the technical means, creative features, achievement goals and effects achieved by the present invention easy to understand, the present invention will be further described below in conjunction with specific illustrations.

As shown in FIG. 1 to FIG. 13, a folding tent capable of being unfolded and folded rapidly provided by the present invention comprises leg tubes 8 and a tent ejector rod part, wherein one end of the tent ejector rod part is hinged to an upper connecting disk 4, the other end of the tent ejector rod part is hinged to an upper portion of the leg tube 8; the tent ejector rod part comprises at least two ejector rod units 1 hinged to each other, and preferably two ejector rod units 1 in a specific embodiment; in other embodiments, three or four ejector rod units 1 can also be provided according to the specification of the folding tent. Specifically, the ejector rod unit 1 hinged to the upper connecting disk 4 is provided with a supporting rod 3 in a fitting manner, and the other end of the supporting rod 3 is hinged to a lower connecting disk 5; the leg tube 8 is provided with a sliding base 81 in a fitting manner, the sliding base 81 is in hinge fit with an inclined rod 7, and the other end of the inclined rod 7 is in hinge fit with the ejector rod unit 1 which is in hinge fit with the upper portion of the leg tube 8. Along with the folding of the folding tent, the sliding base 81 moves up and down along the leg tube 8. A side tent rod part is usually provided in a matched mode, and the side tent rod part usually comprise a plurality of side tent rod units which are hinged to one another and used to connect the leg tubes located on the two sides in a fitting manner.

Based on above, the embodiment, preferably, at least comprises one supporting rod 3, and a connecting rod 2 is further arranged between the supporting rod 3 and the ejector rod unit 1 installed to the supporting rod in a fitting manner, and one end of the connecting rod 2 is used to be in hinge fit with the ejector rod unit 1; a hinge joint is located at a position between a hinge joint of the supporting rod 3 and the ejector rod unit 1 and the upper connecting disk 4, and the other end of the connecting rod 2 is in hinge fit with a sliding part 6; the sliding part 6 slides along the supporting rod 3, and when the sliding part 6 is locked by a locking mechanism 9, the folding tent is in an unfolded state.

When the sliding part 6 slides towards a direction of the lower connecting disk 5 along the supporting rod 3, the folding tent progresses from a folded state to an unfolded state, and when the sliding part 6 is locked by the locking mechanism 9, the folding tent is in a fully unfolded state; when the sliding part 6 is unlocked from the locking mechanism 9, the sliding part 6 slides in a direction away from the lower connecting disk 5 along the supporting rod 3, and the folding tent progresses from the unfolded state to the folded state.

In the above embodiment, a triangular positioning is formed between the supporting rod 3, the connecting rod 2, and the ejector rod unit 1 using a lateral locking mechanism, specifically a locking relationship between the locking mechanism 9 and the sliding part 6. The locking limitation of the whole folding tent is completed, thus completing the folding or unfolding of the folding tent.

When the folding tent is in the folded state, the four leg tubes 8 are separated to make the folding tent progresses from the folded state to the unfolded state. Along with the unfolding of the folding tent, a plurality of ejector rod units 1 in the tent ejector rod part begin to progress from the folded state to the unfolded state, finally making the whole tent ejector rod part in a straight rod or straight rod-like state. Meanwhile, a plurality of supporting rods 3 in hinge fit with the lower connecting disk 5 are changed in a similar way, in this process, the connecting rod 2 hinged to the ejector rod unit 1 changes as the ejector rod unit 1 changes, thus driving the sliding part 6 to slide along the supporting rod 3, specifically, slides towards a direction of the lower connecting disk 5; when the sliding part 6 is locked by the locking mechanism 9, a triangular fixation is formed among the supporting rod 3, the connecting rod 2 and the ejector rod unit 1 to complete the locking of the whole folding tent, thus completing the unfolding of the folding tent.

In one of the preferred embodiments, the sliding part 6 comprises a sliding sleeve body 62, the sliding sleeve body 62 is used to achieve sliding fit with the supporting rod 3, the connecting rod 2 is in hinge fit with the sliding sleeve body 62, the sliding sleeve body 62 is provided with a locking notch 61, the locking notch 61 is used to be in locking fit with the locking mechanism 9. Specifically, the sliding sleeve body 62 is internally provided with a sliding cavity, the supporting rod 3 penetrates through the sliding cavity, and the supporting rod 3 is in clearance fit with the sliding cavity; the sliding sleeve body 62 and the supporting rod 3 may be in a fully-sleeved structure or a partially-sleeved structure, i.e., the sliding cavity is a closed-loop shape or a snap-ring structure with an opening; in other embodiments, the supporting rod 3 may also be provided with a sliding rail groove, the sliding part 6 may be a sliding block component, and the sliding is achieved using the fitting of the sliding block and the sliding rail groove.

In one of the preferred embodiments, the locking mechanism 9 is used to be in installation fit with the lower connecting disk 5, the locking mechanism 9 comprises a lock hook component 91, a lock pin component 92, and a reset spring 93, wherein the lock pin component 92 is used to drive the lock hook component 91 to achieve position change, the reset spring 93 is used to reset the lock hook component 91, and the lock hook component 91 is used to be in locking fit with the locking notch 61; wherein a hinge portion of the lower connecting disk 5 and the supporting rod 3 is provided with an accommodating groove 51, the accommodating groove 51 is used to be in fit with the sliding sleeve body 62, the lock hook 91 can extend into the accommodating groove 51 to be locked with the locking notch 61 on the sliding sleeve body 62 in a fitting manner; when the sliding sleeve body 62 continues to slide, the locking notch 61 on the sliding sleeve body 62 is communicated with the accommodating groove 51, thus making the lock hook component 91 complete the locking of the locking notch 61.

Figure 10:
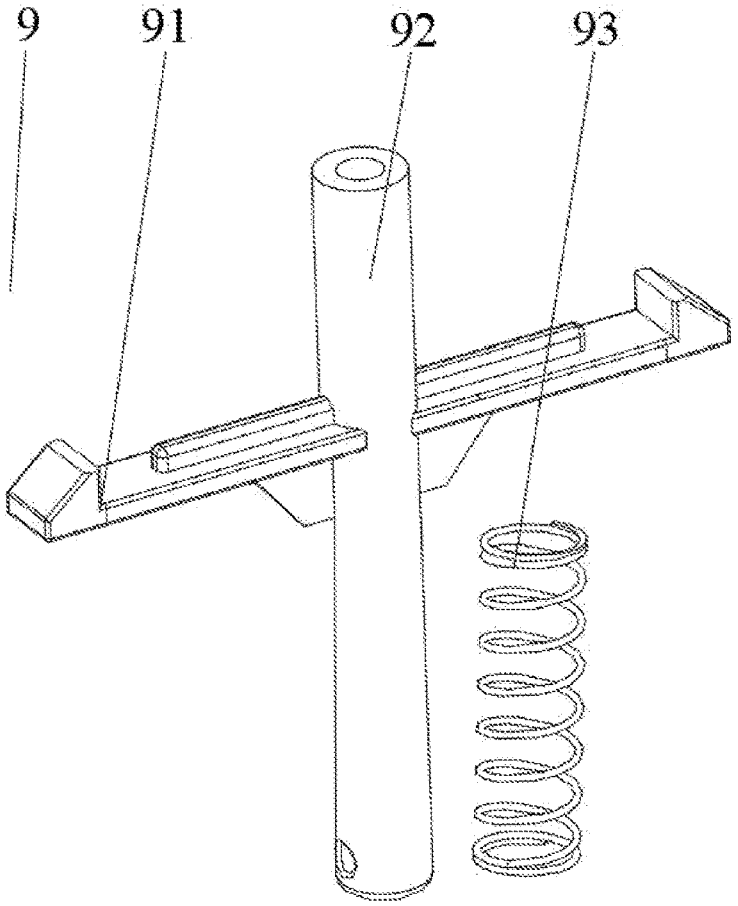
FIG. 10 is a second structure diagram of a locking mechanism of the present invention.
Figure 11:
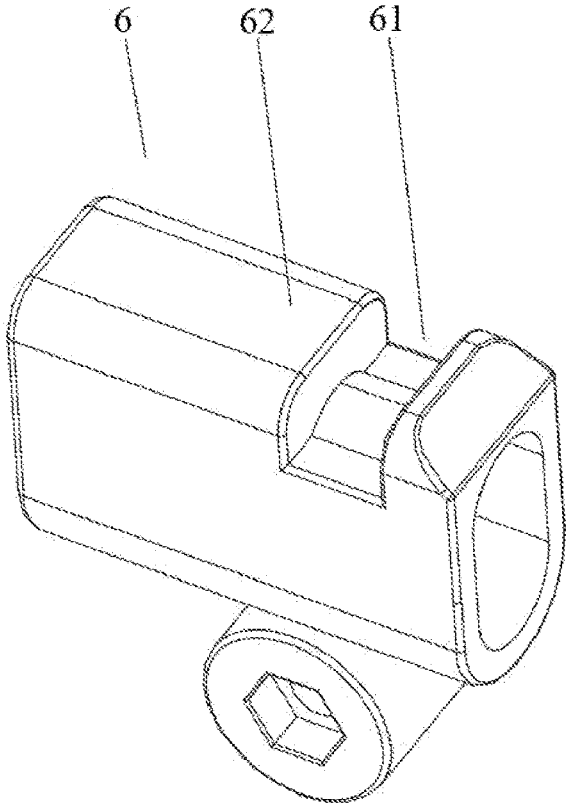
FIG. 11 is a structure diagram of a sliding part of the present invention.

In one of the embodiments, as shown in FIG. 10, the reset spring 93 is sleeved with the lock pin component 92 to achieve the reset effect of the lock pin component 92.

Figure 9:
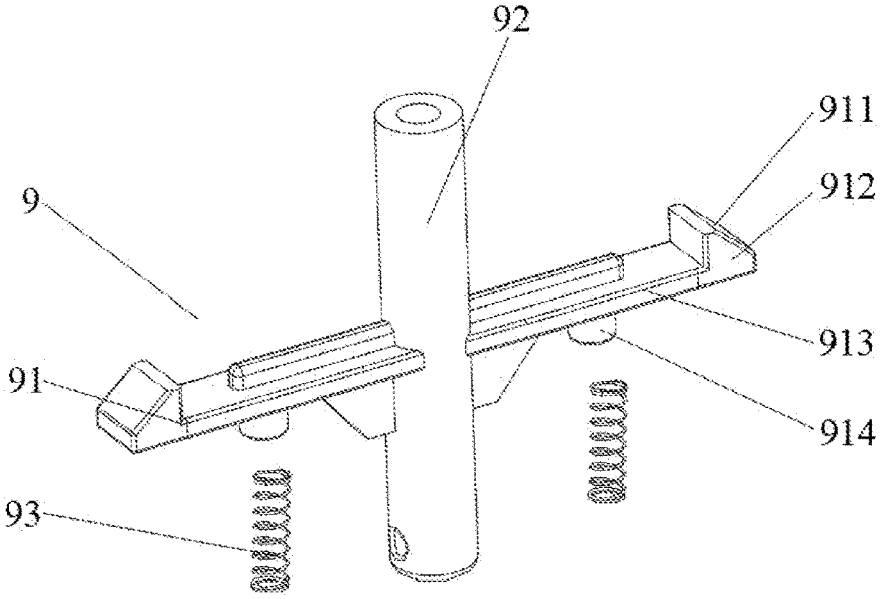
FIG. 9 is a first structure diagram of a locking mechanism of the present invention.

Specifically, as shown in FIG. 9, the lock hook component 91 comprises a lock hook body 912 and a lock hook cantilever 913, one side face of the lock hook body 912 is provided with an inclined plane 911, a lower surface of the lock hook cantilever 913 is provided with a boss 914, the boss 914 is used to be in fit with one end of the reset spring 93, the other end of the reset spring 913 abuts against an inner cavity wall of the lower connecting disk 5, and the other end of the lock hook cantilever 913 is fixedly installed to the lock pin component 92. The lock hook component 91 is used to achieve locking fit with the locking notch 61 in the sliding part 6, wherein at least one side face of the lock hook body 912 is the inclined plane 911, preferably an outer side face; when the sliding part 6 slides to a locking area, a notch edge of the locking notch 61 can abut against the inclined plane 911, and by using the thrust effect, preferably with a structural design of the inclined plane 911, the sliding part 6 can continue to slide inwards more conveniently until the lock hook body 912 is fully retracted after being pressed by force; and when the locking notch 61 continues to slide inwards and the lock hook component 91 can be fully embedded into the locking notch, the lock hook body 912 is clamped into the locking notch 61 using the reset spring 93, thus completing the locking of the sliding part 6.

Wherein the lock pin component 92 comprises a lock pin body which is accommodated in an inner cavity of the lower connecting disk 5, the lock pin body can move up and down along the inner cavity of the lower connecting disk 5; when the lock pin body moves downwards, the lock pin component 92 drives the lock hook component 91 to move to make the lock hook body 912 be disengaged from the locking notch 61, thus completing the unlocking of the sliding part 6.

Preferably, the lower portion of the lock pin body extends to the outside of the lower connecting disk 5 and is installed on a lock pin pull ring 94 in a fitting manner, the lock pin pull ring 94 is used to pull the lock pin body to move up and down along the inner cavity of the lower connecting disk 5 to complete the movement of the lock pin component 92, thus driving the movement of the lock hook component 91 to achieve an unlocking operation of the locking mechanism 9.

Based on above, in one of the preferred embodiments, the lower connecting disk 5 is provided with four supporting rods 3 in a hinge fitting manner, any one supporting rod 3 is provided with the sliding part 6 in a fitting manner, and the sliding part 6 is used to be installed on the single supporting rod 3 in a fitting manner; the connecting rod 2 is hinged to the sliding part 6, and the other end of the connecting rod 2 is in hinge fit with the ejector rod unit 1 which is in hinge fit with the supporting rod 3.

Based on above, in one of the preferred embodiments, the lower connecting disk 5 is provided with four supporting rods 3 in a hinge fitting manner, any two supporting rods 3 are provided with the sliding parts 6 in a fitting manner, and the single sliding parts 6 are used to be installed on the supporting rods 3 in a fitting manner; a connecting rod 2 is hinged to the sliding part 6, and the other end of the connecting rod 2 is in hinge fit with the ejector rod unit 1 which is in hinge fit with the supporting rod 3. In this embodiment, two symmetrical supporting rods 2 are preferably provided with sliding parts 6 in a fitting manner, wherein the locking mechanism 9 for completing the locking structure in fit with the two sliding parts 6 is typically single one, and two internal lock hook components 91 are symmetrically arranged, preferably; wherein the lock pin component 92 may be a shared component, the reset spring 93 is paired with the lock hook component 91 separately or the reset spring 93 component is used to achieve the reset effect on the lock pin component 92.

Based on above, in one of the preferred embodiments, the lower connecting disk 5 is provided with four supporting rods 3 in a hinge fitting manner, all of the four supporting rods 3 are provided with the sliding parts 6 in a fitting manner, and the single sliding parts 6 are used to be installed on the supporting rods 3 in a fitting manner; a connecting rod 2 is hinged to the sliding part 6, and the other end of the connecting rod 2 is in hinge fit with the ejector rod unit 1 which is in hinge fit with the supporting rod 3. In this embodiment, the locking mechanism 9 for completing the locking structure in fit with the four sliding parts 6 is typically single one, and four internal lock hook components 91 are provided, and the single lock hook component 91 is in fit with a single sliding part 6, wherein the lock pin component 92 may be a shared component, the reset spring 93 is paired with the lock hook component 91 separately or the reset spring 93 component is used to achieve the reset effect on the lock pin component 92.

Figure 12:
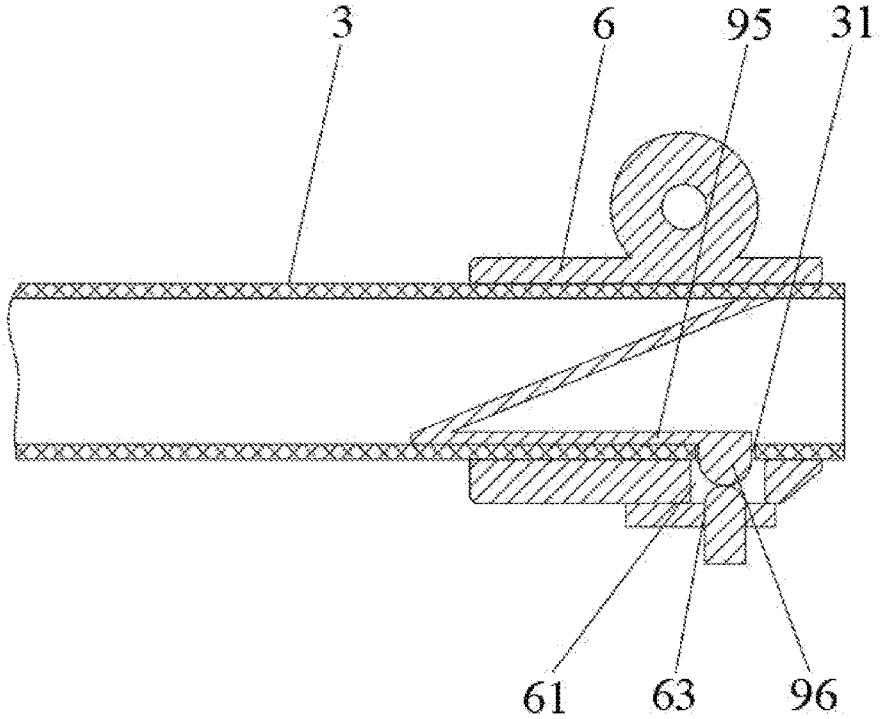
FIG. 12 is a third structure diagram of a locking mechanism of the present invention.

In another of preferred embodiments, in conjunction with what shown in FIG. 12, the locking mechanism 9 comprises a elastic bean part 95, the elastic bean 95 comprises a retractable elastic bean body 96, the elastic bean body 96 is used to be in locking fit with the locking notch 61; preferably, the elastic bean part 95 is used to be installed on the supporting rod 3 in a fitting manner, and the elastic bean part 95 is installed in an inner cavity at a position, close to the lower connecting disk 5, of the supporting rod 3, the supporting rod 3 is provided with a first elastic bean hole 31, and the elastic bean body 96 can protrude from the first elastic bean hole 31. In general, a switching button 63 for releasing the elastic bean body 96 is arranged on the sliding part 6 in a fitting manner, when the sliding part 6 slides to an area where the elastic bean part 95 is located, the elastic bean part 95 can make the elastic bean body 96 complete the locking with the locking notch 61 using the own elastic reset structure characteristic, and the unlocking of the elastic bean body 96 and the locking notch 61 can be achieved using the switching button 63, thus achieving the unfolding or folding of the folding tent.

Figure 13:
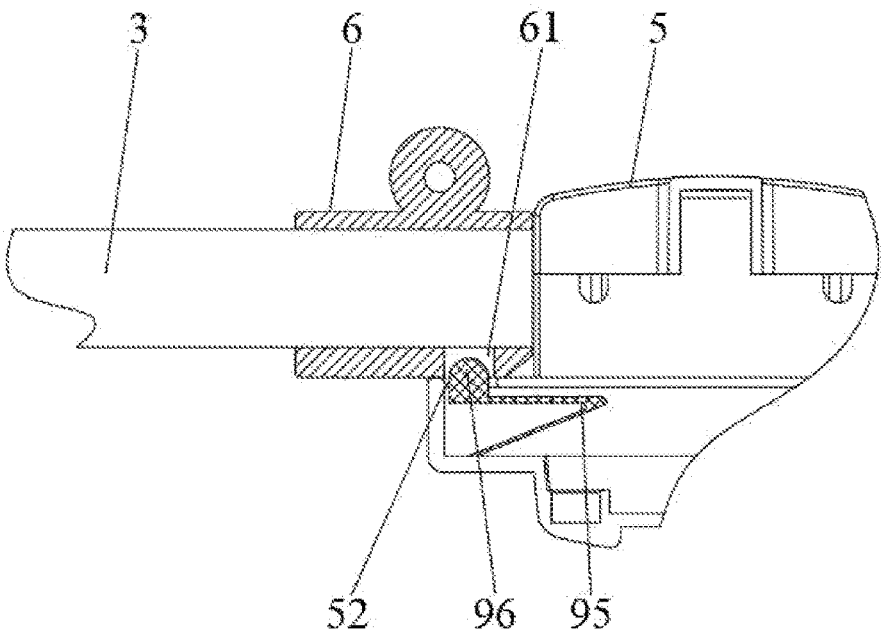
FIG. 13 is a fourth structure diagram of a locking mechanism of the present invention.

In another of preferred embodiments, in conjunction with what shown in FIG. 13, the locking mechanism comprises a elastic bean part 95, the elastic bean part 95 comprises a retractable elastic bean body 96, the elastic bean body 96 is used to be in locking fit with the locking notch 61; the lower connecting disk 5 is provided with an installation cavity groove which is used to install the elastic bean part 95 in a fitting manner; a second elastic bean hole 52 is formed in the installation cavity groove, a hinge portion of the lower connecting disk 5 and the supporting rod 3 is provided with an accommodating groove 51, the accommodating groove 51 is used to be in fit with the sliding sleeve body 62, and the elastic bean body 96 can protrude from the second elastic bean hole 52 to extend into the accommodating groove 51, thus achieving the locking with the locking notch 61. The lower connecting disk 5 is further provided with an operating part which is used to release the locking of the elastic bean body 96 and the locking notch 61; when the sliding part 6 slides to the area where the elastic bean part 95 is located, the elastic bean part 95 can make the elastic bean body 96 complete the locking with the locking notch 61 using the own elastic reset structure characteristic, and the unlocking of the elastic bean body 96 and the locking notch 61 can be achieved using the operating part, thus achieving the unfolding or folding of the folding tent.

Figure 14:
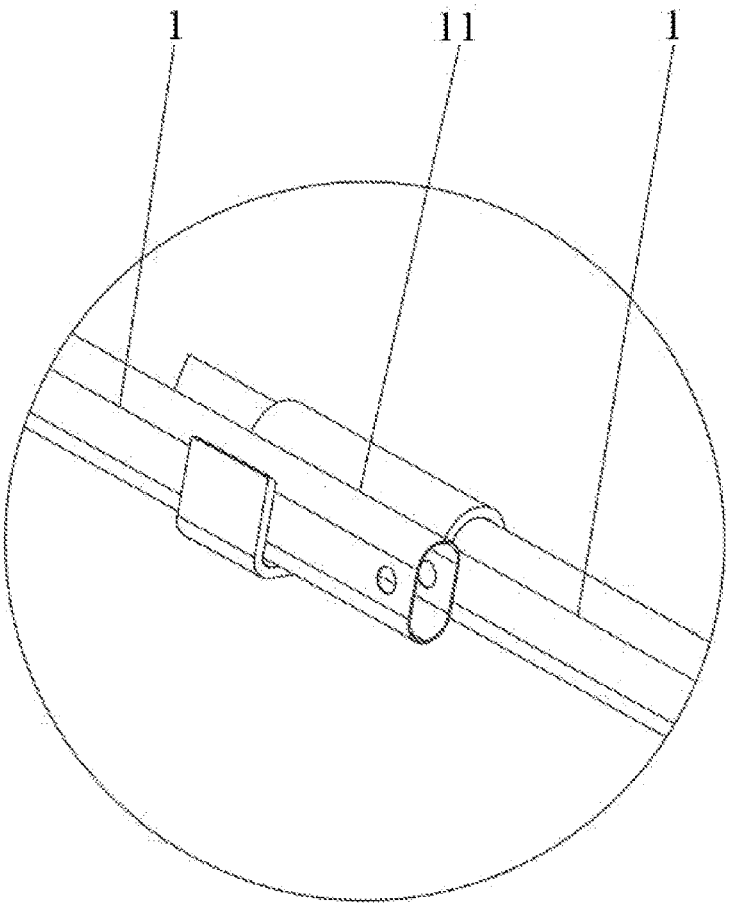
FIG. 14 is a structure diagram of a tent ejector rod part of the present invention.
Figure 15:
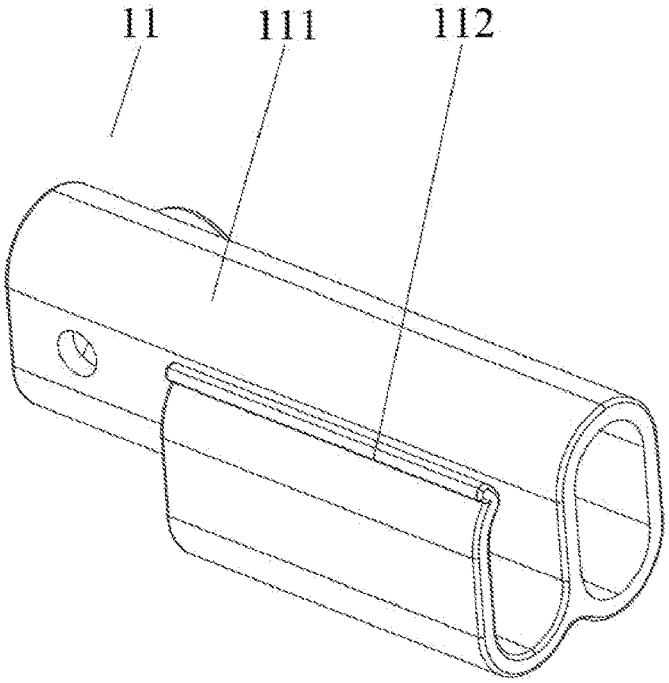
FIG. 15 is a first structure diagram of a clamping seat of the present invention.
Figure 16:
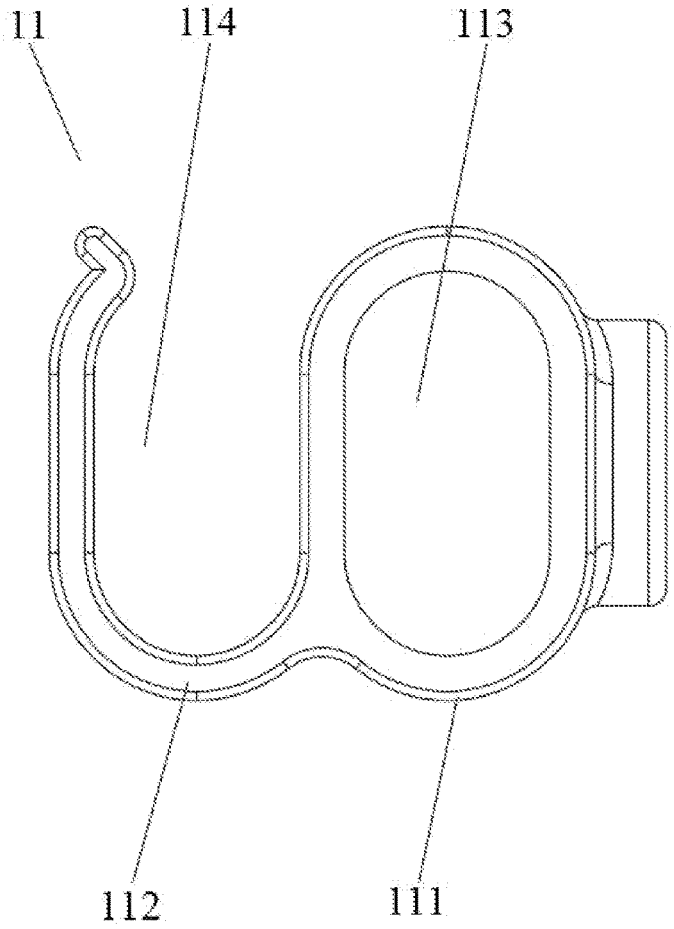
FIG. 16 is a second structure diagram of a clamping seat of the present invention.

Based on above, in one of the preferred embodiments, in conjunction with what shown in FIG. 14 to FIG. 16, a clamping seat 11 is arranged between the ejector rod units 1 in the tent ejector rod part in a fitting manner, wherein the clamping seat 11 is arranged between any two mutually hinged ejector rod units 1 in a fitting manner, and the clamping seat 11 comprises an installation portion 111 and a clamping portion 112; the installation portion 111 is used to be installed on any one of the two mutually hinged ejector rod units 1; when the folding tent is unfolded, the clamping portion 112 is used to clamp another ejector rod unit 1. By adopting the clamping seat 11 structure preferably, when the folding tent is in an unfolded state, the stability between the ejector rod units 1 is enhanced, and the unfolding stability of the whole folding tent is better in combination with the limitation of the locking mechanism 9.

Preferably, an installation sleeve cavity 113 is arranged in the installation portion 111, the installation sleeve cavity 113 and the ejector rod unit 1 are installed in a nesting manner, and the installation portion 111 is installed at adjacent ends or close to end parts of the ejector rod units (1), wherein the installation portion 111 can be provided with a hinge hole in generally to facilitate the hinge arrangement between the ejector rod units 1; the clamping portion 112 is provided with a clamping and limiting groove 114 for limiting the stability of the ejector rod unit 1, and an opening of the clamping and limiting groove 114 is preferably of a necking structure, wherein the clamping seat 11 is preferably made of plastic, which may achieve the fixation and limitation of the ejector rod unit 1 due to the own elasticity, thus improving the unfolding stability of the tent ejector rod part, and facilitating the fixed installation of the clamping seat 11 and the ejector rod unit 1.

A lateral locking structure is adopted through optimal design, and a triangular positioning is formed among the supporting rod 3, the connecting rod 2 and the ejector rod unit 1 to make the whole tent have good stability, thus achieving the advantages of being smooth in locking and reliable in locking; the fitting of the sliding part and the locking mechanism is optimized to achieve quick and convenient unfolding and folding, thus completing the unfolding or folding of the folding tent.

It can be known from the technical knowledge that the present invention can be implemented by other embodiments which are not separated from spiritual essence or necessary features of the present invention. Therefore, the above-disclosed embodiments are merely illustrative and not exclusive in all respects. All changes which are within the scope of the present invention or equivalent to the scope of the present invention are encompassed by the present invention.

To the claims:

1. A folding tent capable of being unfolded and folded rapidly, comprising leg tubes and a tent ejector rod part, wherein the tent ejector rod part has two ends, one end of the tent ejector rod part is hinged to an upper connecting disk, the other end of the tent ejector rod part is hinged to an upper portion of one of the leg tubes; the tent ejector rod part comprises at least two ejector rod units hinged to each other, each ejector rod unit hinged to the upper connecting disk is provided with a supporting rod, each of the supporting rods has a first end and a second end, the first end of each supporting rod is hinged to the corresponding ejector rod unit, and the second end of each supporting rod is hinged to a lower connecting disk, wherein a connecting rod is further arranged between at least one of the supporting rods and the ejector rod unit installed on said one supporting rod, and one end of the connecting rod is hinged to the ejector rod unit; a first hinge joint is located at a position between the supporting rod and the ejector rod unit, a second hinge joint is located at a position between the first hinge joint and the upper connecting disk, and the other end of the connecting rod is hinged to a sliding part; the sliding part slides along the supporting rod, and the sliding part is locked by a locking mechanism when the folding tent is fully unfolded.

2. The folding tent capable of being unfolded and folded rapidly according to claim 1, wherein when the folding tent progresses from a folded state to an unfolded state, the sliding part slides towards a direction of the lower connecting disk along the supporting rod; when the sliding part is unlocked from the locking mechanism, the sliding part can slide in a direction away from the lower connecting disk along the supporting rod, and the folding tent progresses from the unfolded state to the folded state.

3. The folding tent capable of being unfolded and folded rapidly according to claim 2, wherein the sliding part comprises a sliding sleeve body, the sliding sleeve body is slidably connected to the supporting rod, the sliding sleeve body is provided with a locking notch, and the locking notch is configured to lock with the locking mechanism.

4. The folding tent capable of being unfolded and folded rapidly according to claim 3, wherein the locking mechanism is configured for installing with the lower connecting disk, the locking mechanism comprises a lock hook component, a lock pin component and a reset spring; the lock pin component is configured to drive the lock hook component to achieve position change, the reset spring is configured to reset the lock hook component, and the lock hook component is configured to lock with the lock notch.

5. The folding tent capable of being unfolded and folded rapidly according to claim 4, wherein the lock hook component comprises a lock hook body and a lock hook cantilever, one side face of the lock hook body is provided with an inclined plane, and the other end of the lock hook cantilever is fixedly installed on the lock pin component.

6. The folding tent capable of being unfolded and folded rapidly according to claim 5, wherein a lower surface of the lock hook cantilever is provided with a boss, the boss is configured to fit with one end of the reset spring, and the other end of the reset spring abuts against an inner cavity wall of the lower connecting disk.

7. The folding tent capable of being unfolded and folded rapidly according to claim 5, wherein the lock pin component comprises a lock pin body, the lock pin body is accommodated in an inner cavity of the lower connecting disk, and the lock pin body can move up and down along the inner cavity of the lower connecting disk.

8. The folding tent capable of being unfolded and folded rapidly according to claim 7, wherein when the lock pin body moves downwards, the lock pin component drives the lock hook component to move, thus making the lock hook body be disengaged from the locking notch to complete unlocking of the sliding part.

9. The folding tent capable of being unfolded and folded rapidly according to claim 8, wherein a lower portion of the lock pin body extends to the outside of the lower connecting disk and is connected to a lock pin pull ring, and the lock pin pull ring is configured to pull the lock pin body to move down along the inner cavity of the lower connecting disk.

10. The folding tent capable of being unfolded and folded rapidly according to claim 5, wherein an accommodating groove is formed in a hinge portion of the lower connecting disk and the supporting rod, and the accommodating groove is configured to fit with the sliding sleeve body, the lock hook body can extend into the accommodating groove to be locked with the locking notch on the sliding sleeve body.

11. The folding tent capable of being unfolded and folded rapidly according to claim 3, wherein the locking mechanism comprises an elastic bean part, the elastic bean part comprises a retractable elastic bean body, and the elastic bean body is configured to lock with the locking notch.

12. The folding tent capable of being unfolded and folded rapidly according to claim 11, wherein the elastic bean part is configured for installing with the supporting rod, and the elastic bean part is installed in the inner cavity at the position, close to the lower connecting disk, of the supporting rod, an elastic bean hole is formed in the supporting rod, and the elastic bean body can protrude from the elastic bean hole.

13. The folding tent capable of being unfolded and folded rapidly according to claim 11, wherein an installation cavity groove is formed in the lower connecting disk, and the installation cavity groove is configured to install the elastic bean; an elastic bean hole is formed in the installation cavity groove, and the accommodating groove is formed in a hinge portion of the lower connecting disk and the supporting rod, the accommodating groove is configured to connect with the sliding sleeve body, and the elastic bean body can protrude from the elastic bean hole to extend into the accommodating cavity, thus locking with the locking notch.

14. The folding tent capable of being unfolded and folded rapidly according to claim 1, wherein the lower connecting disk is hinged to four supporting rods, any one of the supporting rods or any two of the supporting rods or the four supporting rods are each provided with one sliding part, and each sliding part is installed in one-to-one correspondence with each supporting rod.

15. The folding tent capable of being unfolded and folded rapidly according to claim 1, wherein a clamping seat is arranged between any two mutually hinged ejector rod units, the clamping seat comprises an installation portion and a clamping portion, the installation portion is configured to be installed on any one of the two mutually hinged ejector rod units, and when the folding tent is unfolded, the clamping portion is configured to clamp and fix the other ejector rod unit.

16. The folding tent capable of being unfolded and folded rapidly according to claim 15, wherein an installation sleeve cavity is arranged in the installation portion, the installation sleeve cavity and the ejector rod unit are installed in a nesting manner, and the installation portion is installed at adjacent ends or close to end parts of the ejector rod units.

* * * * *